US008448554B2

(12) United States Patent
Koide et al.

(10) Patent No.: US 8,448,554 B2
(45) Date of Patent: May 28, 2013

(54) BLAST TREATMENT METHOD AND BLAST TREATMENT DEVICE

(75) Inventors: Kenji Koide, Kobe (JP); Ryusuke Kitamura, Kobe (JP); Michel H. Lefebvre, Brussels (BE)

(73) Assignee: Kabushiki Kaisha Kobe Seiko Sho, Kobe-shi (JP)

( * ) Notice: Subject to any disclaimer, the term of this patent is extended or adjusted under 35 U.S.C. 154(b) by 0 days.

(21) Appl. No.: 13/262,070

(22) PCT Filed: Mar. 24, 2010

(86) PCT No.: PCT/JP2010/002068
§ 371 (c)(1),
(2), (4) Date: Feb. 22, 2012

(87) PCT Pub. No.: WO2010/113428
PCT Pub. Date: Oct. 7, 2010

(65) Prior Publication Data

US 2012/0137860 A1 Jun. 7, 2012

(30) Foreign Application Priority Data

Mar. 31, 2009 (JP) ..... 2009-084659

(51) Int. Cl.
*F42D 5/04* (2006.01)

(52) U.S. Cl.
USPC ..... 86/50

(58) Field of Classification Search
USPC ..... 86/50; 588/403, 401
See application file for complete search history.

(56) References Cited

U.S. PATENT DOCUMENTS 7,398,720 B2 7/2008 Fujiwara et al.
8,006,600 B2 8/2011 Fujiwara et al.

(Continued)

FOREIGN PATENT DOCUMENTS

JP 2004 324997 11/2004
JP 2005 291514 10/2005

(Continued)

OTHER PUBLICATIONS

U.S. Appl. No. 13/262,055, filed Sep. 29, 2011, Koide, et al.
U.S. Appl. No. 13/262,419, filed Sep. 30, 2011, Koide, et al.
U.S. Appl. No. 13/262,433, filed Sep. 30, 2011, Fujiwara, et al.

(Continued)

*Primary Examiner* — Michael Carone
*Assistant Examiner* — Reginald Tillman, Jr.
(74) *Attorney, Agent, or Firm* — Oblon, Spivak, McClelland, Maier & Neustadt, L.L.P.

(57) ABSTRACT

Provided is a blast treatment method that can be implemented simply and efficiently blast a treatment subject while preventing fragments of the subject from scattering outward. The blast treatment method is used to blast a treatment subject 10 having a bursting charge 12 and a shell 11, and includes: an inside explosive disposing step of arranging an inside explosive 20 to be used to blast the treatment subject 10 around the treatment subject 10; an outside explosive disposing step of arranging an outside explosive 34 having a greater detonation velocity than the inside explosive 20 at positions on an outer side of the inside explosive 20; and a blast step of simultaneously initiating detonation of the outside explosive 34 at a plurality of positions spaced from each other at predetermined intervals along a particular direction to thereby simultaneously initiate detonations of the inside explosive 20 at a plurality of positions along the particular direction by the detonation of the outside explosive 34, and thereby blasting the treatment subject in such a manner that the detonations of the inside explosive 20 are completed before the detonation of the bursting charge 12 initiated by the detonations of the inside explosive 20 is completed.

10 Claims, 5 Drawing Sheets

U.S. PATENT DOCUMENTS

| | | | | |
|---|---|---|---|---|
| 2009/0131733 | A1 | 5/2009 | Asahina et al. | |
| 2009/0308235 | A1 * | 12/2009 | Lesage et al. | 86/50 |
| 2013/0000469 | A1 * | 1/2013 | Murray | 86/50 |

FOREIGN PATENT DOCUMENTS

| | | |
|---|---|---|
| JP | 2007 271136 | 10/2007 |
| JP | 2007 309550 | 11/2007 |
| JP | 2008 14595 | 1/2008 |

OTHER PUBLICATIONS

U.S. Appl. No. 13/262,028, filed Sep. 29, 2011, Koide, et al.
U.S. Appl. No. 13/262,245, filed Sep. 30, 2011, Koide, et al.
U.S. Appl. No. 13/262,448, filed Sep. 30, 2011, Asahina, et al.
International Search Report issued Jul. 13, 2010 in PCT/JP10/002068 filed Mar. 24, 2010.
International Preliminary Report on Patentability and Written Opinion issued Nov. 15, 2011 in PCT/JP2010/002068.

* cited by examiner

BLAST TREATMENT METHOD AND BLAST TREATMENT DEVICE

TECHNICAL FIELD

The present invention relates to a blast treatment method and a blast treatment device by which an explosive subject, such as military ammunition, is blasted to be disposed of.

BACKGROUND ART

The military ammunition (for example, artillery shells, bombs, landmines, and underwater mines) generally has a structure where a shell made of steel contains therein a bursting charge.

The ammunition is treated by blasting, for example. The treatment method by blasting requires no disassembling operation. This provides adaptability to a disposal not only of favorably preserved munitions, for example, but also of munitions hard to disassemble because of its deterioration over time, deformation, or the like. Further, when bombs including chemical agents hazardous to human bodies are treated by the treatment method, most of the chemical agents are decomposed under the ultra-high temperature and ultra-high pressure generated by explosion. An example of such a blast treatment method is disclosed in Patent Document 1.

According to the method disclosed in the Patent Document 1, a treatment subject is put in a container with an ANFO explosive around it, and the container is wrapped around by a sheet-shaped explosive having a greater detonation velocity than the ANFO explosive. When a predetermined end portion of the sheet-shaped explosive is initiated, the sheet-shaped explosive progressively detonates in a given direction, and the detonation of the sheet-shaped explosive triggers the ANFO explosive to detonate progressively in a given direction. The detonation thereby caused breaks the shell of the object and detonates the bursting charge contained therein so that the object is blasted.

According to the method, the detonation vector of the ANFO explosive filled inside of the sheet-shaped explosive is directed inward by the detonation of the sheet-shaped explosive. When the detonation vector of the ANFO explosive is directed inward, the detonation vector of the bursting charge in the shell, which was originally directed outward, is directed inward. This slows down fragments of the shell scattering outward due to the explosion of the bursting charge.

Depending on the type or density of the bursting charge contained in the treatment subject, the velocity of detonation propagation of the bursting charge may be very high. If the conventional blast treatment method described above is employed to detonate the bursting charge thus characterized, the detonation of the bursting charge may propagates faster than the detonation of the ANFO explosive. Then, the bursting charge detonates before the ANFO explosive provided on its outer side detonates, and as a result, it increases the risk of scattering the shell fragments outward.

Patent Document 1: Japanese Patent Application Publication No. 2005-291514

SUMMARY OF THE INVENTION

To solve the technical problem, the present invention provides a blast treatment method capable of more reliably preventing fragments of a treatment subject, such as a shell, from scattering outward.

To achieve the object, a blast treatment method according to the present invention is a method for blasting a treatment subject having a bursting charge and a shell for housing therein the bursting charge, the method including: an inside explosive disposing step of disposing an inside explosive to be used to initiate detonation of the bursting charge and to blast the treatment subject around the treatment subject; an outside explosive disposing step of disposing an outside explosive having a greater detonation velocity than the inside explosive and used to initiate detonation of the inside explosive at positions on an outer side of the inside explosive; and a blast step of simultaneously initiating detonation of the outside explosive at a plurality of positions spaced from each other at predetermined intervals along a particular direction to thereby simultaneously initiate detonation of the inside explosive at a plurality of positions along the particular direction by the detonation of the outside explosive so that detonation of the bursting charge is initiated by the detonations of the inside explosive, and thereby blasting the treatment subject in such a manner that the detonations of the inside explosive are completed before the detonation of the bursting charge initiated by the detonations of the inside explosive is completed.

According to the method wherein the detonation of the outside explosive is simultaneously initiated at the plurality of positions thereof spaced from each other at predetermined intervals along the particular direction so that the detonation of the inside explosive is simultaneously triggered at the plurality of positions thereof along the particular direction, the treatment subject is blasted in such a manner that the detonations of the inside explosive are completed before the detonation of the bursting charge initiated by the detonations of the inside explosive is completed. Therefore, a detonation vector of the inside explosive directed inward is propagated to the bursting charge not yet detonated, which ensures that a detonation vector of the bursting charge is directed inward. This effectively prevents fragments of the treatment subject from scattering outward.

EMBODIMENTS FOR CARRYING OUT THE INVENTION

Figure 1:
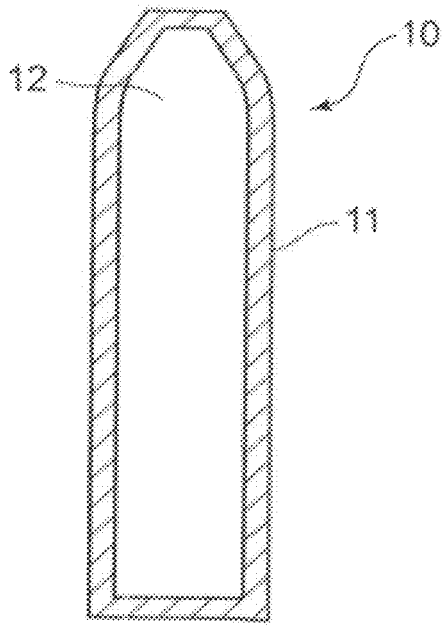
FIG. 1 is a sectional view showing an example of an object to be subjected to blast treatment by a blast treatment method according to the present invention.
Figure 2:
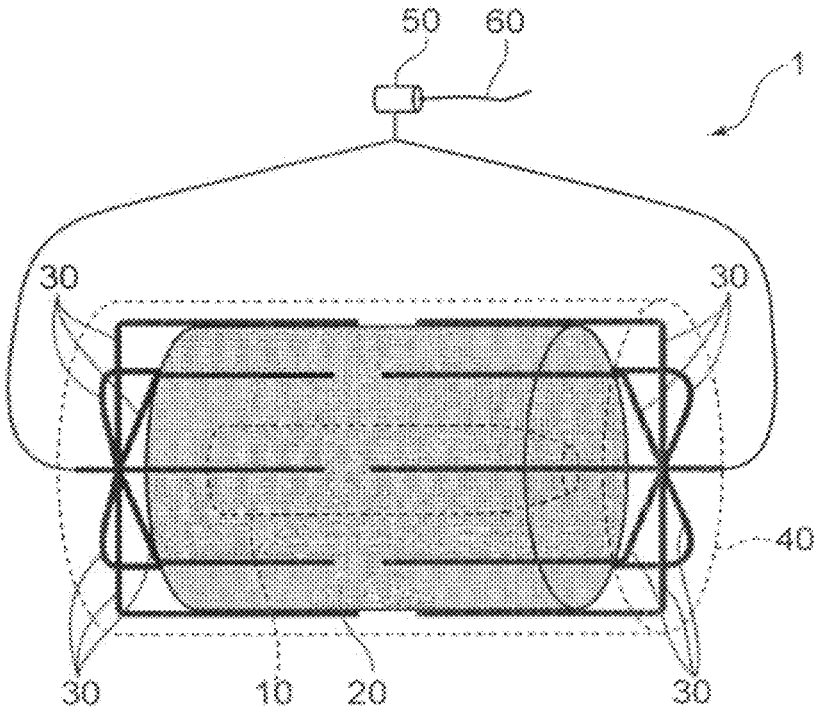
FIG. 2 is a schematic perspective view showing a state where the treatment subject shown in FIG. 1 is mounted in a blast treatment device using the blast treatment method according to the present invention.
Figure 3:
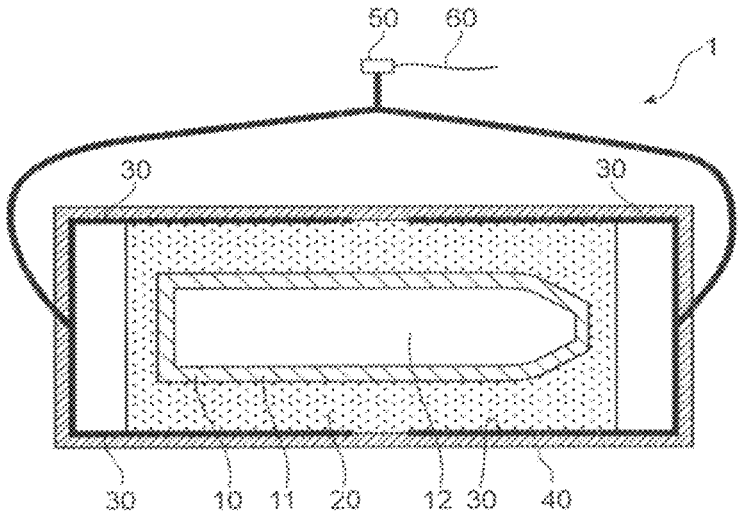
FIG. 3 is a longitudinal sectional view of the state shown in FIG. 2.
Figure 4:
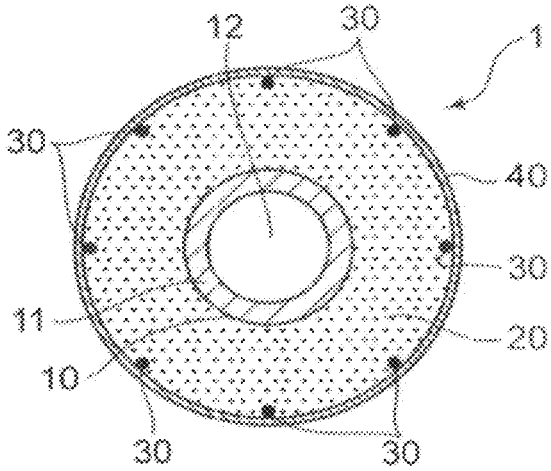
FIG. 4 is a cross-sectional view of the blast treatment device illustrated in FIG. 2.

Hereinafter, an embodiments of a blast treatment method according to the present invention are described in detail referring to the accompanied drawings. FIG. 1 is a sectional view of a conventional munition 10 which is a treatment subject. FIG. 2 is a perspective view of a blast treatment device to which the blast treatment method according to the present invention is applied. FIG. 3 is a longitudinal sectional view of the blast treatment device. FIG. 4 is a cross-sectional view of the blast treatment device.

As illustrated in FIG. 1, the conventional munition 10 has such a shape that axially extends. The conventional munition 10 has a shell 11 made of steel and a bursting charge 12.

Examples of a material of the bursting charge 12 are TNT and picric acid. When the bursting charge 12 is initiated by a fuze not illustrated in the drawings to blast, the shell 11 is broken, and fragments of the shell 11 are scattered around.

For example, as illustrated in FIG. 2, the blast treatment method according to the present invention is used in a blast treatment device 1 including an inside explosive 20, a plurality of cord-like explosive members 30, a container 40, and an electric detonator (initiation device) 50.

The inside explosive 20 is used to blast the conventional munition 10. The cord-like explosive members 30 include an outside explosive 34 used to initiate detonation of the inside explosive 20. The cord-like explosive member 30 has such a shape that extends in a direction. The container 40 houses therein the conventional munition 10, the inside explosive 20, and the cord-like explosive members 30. The electric detonator 50 is used to initiate detonation of the outside explosive 34. These structural elements will be described later in detail.

The blast treatment method includes the steps described below.

1) Outside Explosive Disposing Step

This step is a step of disposing the outside explosive 34 at positions on an outer side of the inside explosive 20.

Figure 5:
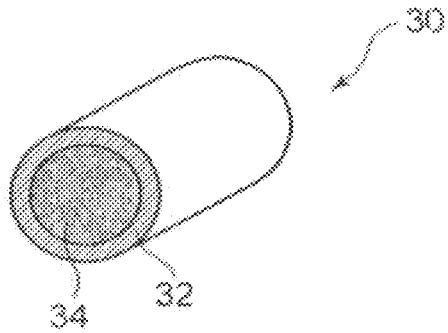
FIG. 5 is an explanatory view showing an exemplary cord-like explosive element member used for the blast treatment device shown in FIG. 2.

The cord-like explosive members 30 used in this embodiment are obtained from string-like detonating cord detonating cord in which a powder core, PETN, is covered with an external cylinder 32. As illustrated in FIG. 5, the external cylinder 32 and the outside explosive 34 made of PETN and housed inside the external cylinder 32 constitute the cord-like explosive members 30. A material of the external cylinder 32 is, for example, plastic linearly extending in a direction. The cord-like explosive members 30 thus structurally characterized have a detonation velocity of approximately 6 to 7 km/s.

In this step, the long string-like detonating cord prepared in advance is cut so as to fit the size and shape of the container 40 to provide the plurality of cord-like explosive members 30. According to the present exemplary embodiment, 16 cord-like explosive members 30 all having an equal length are formed from the detonating cord.

Then, eight of the 16 cord-like explosive members 30 are provided on an axial end of the container 40, and the other eight are provided on the other axial end of the container 40 as illustrated in FIG. 2. The container 40 has a substantially cylindrical shape extending in a direction in parallel with an axial direction of the conventional munition 10 which is a longitudinal direction thereof. Therefore, the cord-like explosive members 30 are arranged on axial ends of the conventional munition 10 on both sides thereof. More specifically, eight of the 16 cord-like explosive members 30 and the other eight thereof are arranged on an inner surface of the container 40 at the axial ends on both sides thereof so that the eight explosive members 30, eight each, are arranged in parallel with the axial direction of the container 40 and equally spaced from one another. Then, the eight explosive members 30, eight each, are bundled into one on bottom surfaces of the container 40 in the axial direction on both sides thereof so that they are respectively bundled into one on the center axis of the container 40. The cord-like explosive members 30 are not provided in vicinity of an axial center portion of the container 40.

The container 40 should be able to maintain the shape of the inside explosive 20 when the inside explosive 20 is loaded therein. The container 40 may be shape-retainable such as a case made of hard resin, or may be a flexible bag.

2) Inside Explosive Disposing Step

In this step the inside explosive 20 is disposed so as to encompass the conventional munition 10.

In this step, the conventional munition 10 is first contained in substantially the center portion of the container 40 so that the axis line of the conventional munition 10 and the center axis of the container 40 exactly match each other.

Then, the inside explosive 20 is poured into between the outer surface of the conventional munition 10 and the inner surface of the container 40 so that the conventional munition 10 is surrounded by the inside explosive 20. The inside explosive 20 is poured into the container 40 so that the inside explosive 20 does not reach the axial bottom surfaces of the container 40 on both sides thereof. More specifically, there are predetermined clearances left unfilled between the axial both ends of the inside explosive 20 and the axial both bottom surfaces of the container 40 after the inside explosive 20 is poured into the container 40.

Though the inside explosive 20 is not particularly limited as far as it has a lower detonation velocity than the outside explosive 34, it is preferable to use an explosive having fluidity such as powder or liquid. Specific examples of the explosive are emulsion explosive, slurry explosive, and ANFO explosive. The emulsion explosive and the slurry explosive both have a detonation velocity of approximately 5 km/s. The ANFO explosive has a detonation velocity of approximately 3 km/s. Therefore, the outside explosive 34 has a considerably greater detonation velocity than the inside explosive 20.

3) Blast Step

In this step, the outside explosive 34 included in the cord-like explosive members 30 is initiated to thereby detonate the inside explosive 20 so that the conventional munition 10 is blasted by a detonation power of the inside explosive 20.

In this step, the electric detonator 50 is commonly connected to the cord-like explosive members 30. More specifically, the electric detonator 50 is connected to a bundle of the cord-like explosive members 30 bundled into one on each of the axial bottom surfaces of the container 40 so that all of the cord-like explosive members 30 are equally distant from the electric detonator 50.

Next, the electric detonator 50 is connected via a firing cable 60 to a firing device not illustrated in the drawings.

Then, the firing device is manipulated. Then, the electric detonator 50 simultaneously initiates all the outside explosive 34 included in all of the plurality of cord-like explosive members 30. The detonation of the outside explosive 34 simultaneously starts in all of the cord-like explosive members 30.

First, the respective detonations of the outside explosive 34 are propagated radially outward from the center axis of the container 40 on the axial bottom surfaces both of the container 40. The respective detonations of the outside explosive 34 are then propagated on an outer peripheral surface of the container 40 along a direction in parallel with the center axis of the container 40. The detonations of the outside explosive 34 are propagated from the axial both ends of the container 40 so as to approach each other. The detonation waves of the outside explosive 34 thus propagated collide with one another in vicinity of the axial center portion of the container 40, generating a high-pressure gas in vicinity of the center portion. Thus, the center portion is the destination where the propagated detonations end.

The detonation of the inside explosive 20 is initiated on the axial both ends thereof by the detonation waves of the outside explosive 34 surrounding the inside explosive 20, and an detonation power of the outside explosive 34 directed inward is applied to the inside explosive 20 at the time. Therefore, the detonation vector of the inside explosive 20 is directed inward. The inside explosive 20, while generating the detonation waves directed inward as a result of the detonations of the outside explosive 34, is detonated progressively from the axial both ends toward vicinity of the axial center portion of the container 40 along the center axis of the container 40.

When the inside explosive 20 starts to detonate, the detonation power of the inside explosive 20 is transmitted to the conventional munition 10 arranged inside of the inside explosive 20. The detonation power of the inside explosive 20 compresses the shell 11 of the conventional munition 10, and also initiates detonation of the bursting charge 12 provided inside the conventional munition 10. The bursting charge 12 starts to detonate at the both ends thereof in the axial direction of the container 40.

More specifically, when the detonation waves of the inside explosive 20 are propagated to the shell 11 and finally arrive at the bursting charge 12, the bursting charge 12 is initiated after a short detonation latency is over. The detonation waves of the bursting charge 12 are propagated at an increasingly higher speed along a direction toward the center axis of the container 40. The detonations of the bursting charge 12 initiated on the axial both ends of the container 40 and thus propagated end with colliding with the detonation waves propagated from the other end in vicinity of the center portion of the container 40.

The propagation of the detonations of the inside explosive 20 thus progress from the axial both ends toward the axial center portion of the container 40 at the same time. Therefore, a propagation time for the detonations of the inside explosive 20 to end is, by simple arithmetic, at most half a conventional propagation time required for the inside explosive 20 to unidirectionally progress from one end to the other. Thus, the detonation of the inside explosive 20 is completed in a shorter time as compared to the related art wherein the detonation of the inside explosive 20 starts on one end alone, propagating toward the other end. Particularly when the detonations of the inside explosive 20 are propagated in the axial direction of the conventional munition 10 having such a shape that axially extends as in the present exemplary embodiment, an amount of time necessary for detonating the inside explosive 20 is significantly reduced.

As described above, when the detonation waves of the inside explosive 20 finally arrive at the bursting charge 12, the bursting charge 12 is initiated after the short initiation latency is over. The detonation waves of the bursting charge 12 cease to be propagated in vicinity of the center portion of the container 40 before the propagation overly increases its speed.

Therefore, the detonation propagation of the bursting charge 12 ends before overtaking the detonation propagation of the inside explosive 20. When the bursting charge 12 is detonated, the inward detonation power is always applied thereto from the inside explosive 20 provided around the bursting charge 12. This directs the detonation vector of the bursting charge 12 inward, thereby preventing the fragments of the shell 11 from scattering outward.

The cord-like explosive members 30 are not provided in vicinity of the center portion of the container 40. Therefore, the detonation power is not newly induced by the outside explosive 34 in vicinity of the center portion. However, the high-pressure gas is generated in vicinity of the center portion by the collision of the detonation waves of the outside explosive 34 as described above. The high-pressure gas applies a power having inward directionality to the inside explosive 20, serving to direct the detonation vector of the inside explosive 20 inward in vicinity of the center portion. Then, the detonation vector of the bursting charge 12 is directed inward as well. As a result, the fragments of the shell 11 are prevented from scattering outward in vicinity of the center portion of the container 40.

According to the present exemplary embodiment, the cord-like explosive members 30 including the outside explosive 34 provided on the outer peripheral surface of the inside explosive 20 are spaced from one another as illustrated in FIG. 2, for example. The outside explosive 34 has an adequately large detonation power. Therefore, the detonation waves of the outside explosive 34 are instantaneously propagated around the cord-like explosive members 30, and the detonation power of the outside explosive 34 is applied simultaneously to the entire outer peripheral portion of the inside explosive 20 in cross section perpendicular to the center axis thereof. Thus, the detonation is triggered substantially at the same time in all around the outer peripheral portion of the inside explosive 20. As a result, the detonation power of the inside explosive 20 converges on the conventional munition 10.

Because the clearances are provided between the inside explosive 20 and the axial bottom surfaces both of the container 40, the detonation waves of the outside explosive 34, when propagating radially outward on the axial bottom surfaces both of the container 40, are not directly transmitted to the inside explosive 20. This structural advantage helps the detonation waves of the outside explosive 34 to be transmitted to the inside explosive 20 from the outer peripheral surface thereof, thereby focusing the detonation vector of the inside explosive 20 on the conventional munition 10.

According to the blast treatment method described so far wherein the outside explosive 34 having a larger detonation velocity is arranged on the outer side of the inside explosive 20 so that the outside explosive 34 initiates the detonation of the inside explosive 20, the fragments of the conventional munition 10 can be prevented from scattering outward.

Particularly, the method according to the present invention initiates the detonation of the outside explosive 34 at the both ends thereof in the axial direction of the container 40, in other words, in the longitudinal direction of the conventional munition 10. As a result, the detonation of the outside explosive 34 starts at the both ends thereof at the same time, and the detonation of the inside explosive 20 then starts at the both ends thereof at the same time. The detonations of the inside explosive 20 thus respectively started then are propagated so as to approach each other along the longitudinal direction of the conventional munition 10. Therefore, the detonations of the inside explosive 20 are completed relatively promptly on the periphery of the conventional munition 10, meaning that the detonations of the inside explosive 20 are propagated in the longitudinal direction sooner than the detonation of the bursting charge 12. As a result, the inward detonation waves of the inside explosive 20 are propagated to the bursting charge 12, which ensures that the detonation vector of the bursting charge 12 is directed inward.

Because the only detonator (initiation device) 50 is used to initiate the detonation of the outside explosive 34 at the both ends thereof, the outside explosive 34 can be easily initiated at the both ends simultaneously.

The plurality of cord-like explosive members 30 including the outside explosive 34 and having such a shape that unidirectionally extends are arranged on the outer side of the inside explosive 20. Therefore, the outside explosive 34 can be easily arranged suitably for any shape of the conventional munition 10. The cord-like explosive members 30 are arranged in parallel with the longitudinal direction of the conventional munition 10 so that the detonation of the outside explosive 34 and the detonation of the inside explosive 20 induced by the detonation of the outside explosive 34 are both propagated in parallel with the longitudinal direction. Therefore, completion of the detonation of the inside explosive 20 is accelerated as compared to, for example, a structure where the cord-like explosive members 30 are arranged in a spiral shape on the outer peripheral surface of the inside explosive 20.

The cord-like explosive members 30 arranged around the inside explosive 20 are equally spaced from one another so that the outside explosive 34 included in the cord-like explosive members 30 equally initiates the outer peripheral portion of the inside explosive 20. Therefore, the outside explosive 34 used to initiate the inside explosive 20 can be reduced.

Figure 6:
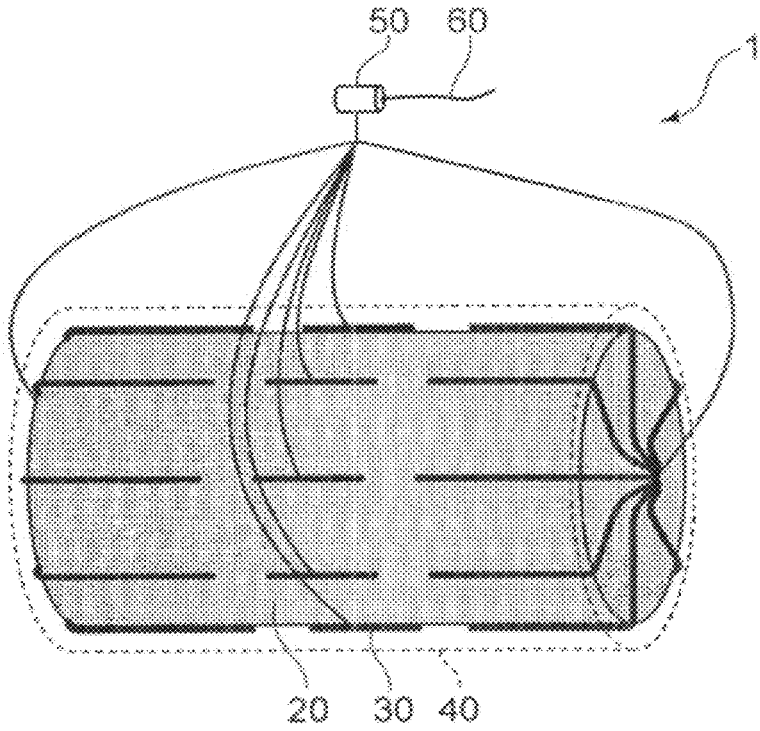
FIG. 6 is a schematic perspective view showing another embodiment of the blast treatment device used for the blast treatment method according to the present invention.

Though it is illustrated in the present exemplary embodiment that the both ends of the outside explosive 34 in the longitudinal direction of the conventional munition 10 are initiated, the sections of the outside explosive 34 where the detonation is initiated is not necessarily limited thereto as far as the outside explosive 34 is initiated at a plurality of positions spaced from each other in a predefined direction. As illustrated in FIG. 6, for example, the outside explosive 34 may be initiated in vicinity of the center portion thereof in the longitudinal direction of the conventional munition 10 as well as the both ends thereof in the longitudinal direction of the conventional munition 10.

The present exemplary embodiment uses the 16 cord-like explosive members 30 in which the detonating cord contains the outside explosive 34 (PETN) as its powder core, and the powder core is covered with the external cylinder 32 made of plastic. However, the number of the cord-like explosive members 30 and the types of the outside explosive 34 and the external cylinder 32 are not necessarily limited thereto. Further, the cord-like explosive members 30 per se may not be necessarily structured as described. Other examples of the cord-like explosive members 30 are; composition C-4 formed in the shape of a cord, and a sheet of explosive member formed in the shape of a tape in which an explosive such as PETN is mixed. In place of using the cord-like explosive members 30, a sheet of explosive member in which an explosive such as PETN is mixed, for example, may be provided on the outer side of inside explosive 20.

According to the present exemplary embodiment, the outside explosive 34 is not provided at the axial center portion of the container 40, however, the outside explosive 34 may be provided on the whole outer circumference of the inside explosive 20. As illustrated in FIG. 6, the interior of the container 40 may be completely filled with the inside explosive 20 without any clearance between the both ends of the inside explosive 20 and the axial bottom surfaces both of the container 40.

The inside explosive 20 is not necessarily limited to the examples given above. However, the emulsion explosive is relatively inexpensive and has a greater detonation velocity than the ANFO explosive, thereby more speedily propagating the detonation. Therefore, the emulsion explosive helps to more efficiently blast the subject, while succeeding in cost reduction of the whole blasting operation.

The container 40 according to the present exemplary embodiment has a cylindrical shape, however, the shape of the container 40 is not necessarily limited thereto. In place of using the container 40, an explosive having plasticity may be used as the inside explosive 20. In the case where such an inside explosive is used, the inside explosive 20 is securely provided around the conventional munition 10, and the cord-like explosive members 30 are directly arranged on the outer periphery of the inside explosive 20. The inside explosive 20 may be put in a plurality of bags so that the plurality of bags laden with the inside explosive 20 are mounted on the outer periphery of the conventional munition 10, in which case the outside explosive 34 is arranged around the bags. Another possible structure is to house the conventional munition 10 and the inside explosive 20 alone in the container 40 and then provide the outside explosive 34 on the outer side of the container 40.

The treatment subject by the blast treatment method is not necessarily limited to the conventional munition 10. The blast treatment method can be applied to chemical bombs laden with explosives such as TNT, picric acid, and RDX, blister agents such as mustard and lewisite, sneezing agents such as DC and DA, and chemical agents such as phosgene, sarin, and hydrocyanic acid. The blast treatment device 1 can also be used to blast a unit containing the bursting charge after the conventional munition 10 is disassembled.

As described so far, the present invention provides a blast treatment method for blasting a treatment subject having a bursting charge and a shell for housing therein the bursting charge, the method comprising: an inside explosive disposing step of disposing an inside explosive to be used to initiate detonation of the bursting charge and to blast the treatment subject around the treatment subject; an outside explosive disposing step of disposing an outside explosive having a greater detonation velocity than the inside explosive and used to initiate detonation of the inside explosive at positions on an outer side of the inside explosive; and a blast step of simultaneously initiating detonation of the outside explosive at a plurality of positions spaced from each other at predetermined intervals along a particular direction to thereby simultaneously initiate detonation of the inside explosive at a plurality of positions along the particular direction by the detonation of the outside explosive so that detonation of the bursting charge is initiated by the detonations of the inside explosive, and thereby blasting the treatment subject in such a manner that the detonations of the inside explosive are completed before the detonation of the bursting charge initiated by the detonations of the inside explosive is completed.

According to the method, the outside explosive having a greater detonation velocity is disposed on the outer side of the inside explosive so that the inside explosive is initiated by the outside explosive. Of the detonation waves of the outside explosive, the detonation waves directed inward are propagated to the inside explosive so that the detonation vector of the inside explosive is directed inward. When the inward detonation vector of the inside explosive is propagated to the treatment subject, the detonation vector of the bursting charge loaded in the treatment subject is directed inward. As a result, the fragments of the treatment subject are prevented from scattering outward.

According to the blast treatment method, the outside explosive is initiated simultaneously at the plurality of positions spaced from one another at given intervals along the particular direction so that the detonation of the inside explosive is thereby simultaneously initiated at the plurality of positions in the particular direction. Therefore, the detonations of the inside explosive are completed before the detonation of the bursting charge initiated by the detonations of the inside explosive is completed. Then, the detonation vector of the inside explosive is more reliably propagated to the bursting charge, which further ensures that the detonation vector of the bursting charge is directed inward.

As far as the detonation of the inside explosive starts simultaneously at the plurality of positions, the detonations of the inside explosive end all over the outer side of the treatment subject before the detonation propagation of the bursting charge overtakes the detonation propagation of the inside explosive. This further ensures that the inward detonation vector of the inside explosive is propagated to the bursting charge not yet detonated, and the detonation vector of the bursting charge thereby directed inward more reliably prevents the fragments of the treatment subject from scattering outward.

According to the present invention, it is preferable that in the blast step, both ends of the outside explosive in the particular direction are simultaneously initiated to thereby simultaneously start the detonation of the inside explosive at both ends thereof in the particular direction by the detonation of the outside explosive, and thereby propagating the detonations of the inside explosive which respectively have started on the both ends thereof in the particular direction so that the detonations approach each other along the particular direction.

According to the method wherein the inside explosive is initiated at one end of the inside explosive in the particular direction which is a detonation start position and at the other end of the inside explosive which is another detonation start point most distant from the one end in the particular direction, the detonations of the inside explosive come to an end in substantially half the time it takes for the detonation of the inside explosive which started at one end thereof alone in the particular direction to end. Therefore, before the detonation of the inside explosive which started at the other end is propagated to the one end before the detonation of the bursting charge which started at one end in the particular direction overtakes the detonation of the inside explosive. This further ensures that the detonation vector of the inside explosive propagated to the bursting charge is directed inward, thereby more reliably preventing the fragments of the treatment subject from scattering outward.

The treatment subject has such a shape that extends in a given direction. In the case where the bursting charge is initiated on one end thereof alone in the longitudinal direction, the detonation propagation of the bursting charge may overtake the detonation propagation of the inside explosive. However, as far as the both ends of the outside explosive in the longitudinal direction of the treatment subject are initiated at the same time in the blast step to simultaneously start the detonation of the inside explosive on the both ends thereof, completion of the inside explosive detonation is accelerated.

According to the present invention, it is preferable that the outside explosive disposing step includes a step of arranging a plurality of cord-like explosive members, including the outside explosive and having a shape that extends in a direction, at positions on the outer side of the inside explosive in parallel with the particular direction, and in the blast step, the detonation of the outside explosive included in the plurality of cord-like explosive members is initiated at the both ends in the particular direction.

According to the method, the cord-like explosive members formed so as to extend in one direction are arranged on the outer side of the inside explosive so that the outside explosive is arranged on the outer side of the inside explosive. Therefore, when the cord-like explosive members are differently arranged or shaped, a broad range of treatment subjects can be suitably handled regardless of their different sizes and shapes. Thus, the same cord-like explosive members can be used to blast any subjects having various sizes and shapes, which makes it unnecessary to prepare beforehand explosive members formed in shapes suitable for the shapes of the different treatment subjects in order to arrange the outside explosive on the outer side of the inside explosive. This improves the efficiency of the blasting operation, thereby succeeding in cost reduction.

According to the method wherein the cord-like explosive members are arranged in parallel with the particular direction, the detonations of the outside explosive included in the cord-like explosive members and the detonations of the inside explosive triggered by the detonation of the outside explosive are propagated in parallel with the particular direction. Therefore, the detonations of the inside explosive which progress along the particular direction come to an end sooner. This further ensures that the detonation vector of the inside explosive propagated to the bursting charge is directed inward, thereby more reliably preventing the fragments of the treatment subject from scattering outward.

The outside explosive disposing step preferably includes a step of arranging the plurality of cord-like explosive members on an outer periphery of the inside explosive to be equally spaced from each other.

As a result of the additional step, the outside explosive included in the cord-like explosive members equally initiates the outer peripheral portion of the inside explosive. This reduces the volume of the outside explosive used to initiate the inside explosive.

The blast step preferably includes a step of propagating the detonations of the outside explosive simultaneously initiated on the both ends thereof in the particular direction so as to approach each other along the particular direction, and thereby making the detonations of the outside explosive crash into each other at a position on the outer side of the inside explosive near a center portion of the inside explosive in the particular direction.

The additional step makes the detonation waves of the outside explosive crash into each other, thereby generating a high-pressure gas having a large energy at the center portion in the particular direction. The high-pressure gas thus generated prevents the fragments of the treatment subject from scattering outward at the center portion in the particular direction.

The outside explosive disposing step particularly includes a step of arranging the outside explosive at any positions on the outer side of the inside explosive except the center portion of the inside explosive in the particular direction. The blast step preferably includes a step of making the detonations of the outside explosive crash into each other in a region where the outside explosive is not provided after propagating the detonations so as to approach each other in the particular direction.

These additional steps arrange the outside explosive at any positions of the inside explosive but the center portion thereof in the particular direction while preventing the fragments of the treatment subject from scattering outward using the high-pressure gas, thereby reducing the volume of the outside explosive to be used for cost reduction.

The both ends of the outside explosive in the particular direction are preferably connected to a common initiation device so that the both ends of the outside explosive are simultaneously initiated by the common initiation device in the blast step.

Then, the both ends of the outside explosive can be more easily initiated at the same time.

The present invention further provides a blast treatment device, including: an inside explosive disposed on an outer side of a treatment subject and used to blast the treatment subject; an outside explosive having a greater detonation velocity than the inside explosive; and a initiation device to be used to initiate detonation of the outside explosive, wherein the initiation device is connected to the outside explosive so that the outside explosive is initiated at a plurality of positions spaced from each other at predetermined intervals along a particular direction, the plurality of positions being such that detonations of the inside explosive detonated by the detonations of the outside explosive are completed earlier than the detonation of the bursting charge detonated by the detonations of the inside explosive.

The device wherein the initiation device initiates the outside explosive at the plurality of positions can more speedily complete the inside explosive detonation so that the inward detonation vector of the inside explosive is more reliably propagated to the bursting charge. This inward detonation vector of the inside explosive more reliably prevents the fragments of the object, such as a shell, from scattering outward.

The common initiation device of the blast treatment device is preferably connected to both ends of the outside explosive in the particular direction.

When the initiation device of the blast treatment device is thus connected to the both ends, the initiation device initiates the both ends of the outside explosive in the particular direction, thereby initiating the detonations of the inside explosive and the bursting charge on both ends thereof. As a result, the detonations of the inside explosive come to an end before the detonation propagation of the bursting charge overtakes the detonation propagation of the inside explosive. This further ensures that the inward detonation vector of the inside explosive is propagated to the bursting charge.

The invention claimed is:

1. A blast treatment method for blasting a treatment subject having a bursting charge and a shell for housing therein the bursting charge, the method comprising:

an inside explosive disposing step of disposing an inside explosive to be used to initiate detonation of the bursting charge and to blast the treatment subject around the treatment subject;

an outside explosive disposing step of disposing an outside explosive having a greater detonation velocity than the inside explosive and used to initiate detonation of the inside explosive at positions on an outer side of the inside explosive; and a blast step of simultaneously initiating detonation of the outside explosive at a plurality of positions spaced from each other at predetermined intervals along a particular direction to thereby simultaneously initiate detonation of the inside explosive at a plurality of positions along the particular direction by the detonation of the outside explosive so that detonation of the bursting charge is initiated by the detonations of the inside explosive, and thereby blasting the treatment subject in such a manner that the detonations of the inside explosive are completed before the detonation of the bursting charge initiated by the detonations of the inside explosive is completed.

2. The blast treatment method according to claim 1, wherein in the blast step, both ends of the outside explosive in the particular direction are simultaneously initiated to thereby simultaneously start the detonation of the inside explosive at both ends thereof in the particular direction by the detonation of the outside explosive, and thereby propagating the detonations of the inside explosive which respectively have started on the both ends thereof in the particular direction so that the detonations approach each other along the particular direction.

3. The blast treatment method according to claim 2, wherein the treatment subject has a shape that extends in a given direction, and in the blast step, the detonation of the outside explosive is initiated at the both ends thereof in a longitudinal direction of the treatment subject, with the longitudinal direction being the particular direction.

4. The blast treatment method according to claim 2, wherein the outside explosive disposing step includes a step of arranging a plurality of cord-like explosive members, including the outside explosive and having a shape that extends in a direction, at positions on the outer side of the inside explosive in parallel with the particular direction, and in the blast step, the detonation of the outside explosive included in the plurality of cord-like explosive members is initiated at the both ends in the particular direction.

5. The blast treatment method according to claim 4, wherein the outside explosive disposing step includes a step of arranging the plurality of cord-like explosive members on an outer periphery of the inside explosive to be equally spaced from each other.

6. The blast treatment method according to claim 2, wherein the blast step includes a step of propagating the detonations of the outside explosive simultaneously initiated on the both ends thereof along the particular direction so as to approach each other along the particular direction, and thereby making the detonations of the outside explosive crash into each other at a position on the outer side of the inside explosive near a center portion of the inside explosive in the particular direction.

7. The blast treatment method according to claim 6, wherein the outside explosive arrangement step includes a step of arranging the outside explosive at any positions on the outer side of the inside explosive except the center portion of the inside explosive in the particular direction, and the blast step includes a step of making the detonations of the outside explosive crash into each other in a region where the outside explosive is not provided after propagating the detonations so as to approach each other along the particular direction.

8. The blast treatment method according to claim 2, wherein

In the blast step, the both ends of the outside explosive in the particular direction are connected to a common initiation device so that the both ends of the outside explosive are simultaneously initiated by the common initiation device.

9. A blast treatment device in which the blast treatment method according to claim 1 is used to blast a treatment subject, the device comprising:

an inside explosive disposed on an outer side of a treatment subject and used to blast the treatment subject;

an outside explosive having a greater detonation velocity than the inside explosive; and a initiation device to be used to initiate detonation of the outside explosive, wherein the initiation device is connected to the outside explosive so that the outside explosive is detonated at a plurality of positions spaced from each other at predetermined intervals along a particular direction, the plurality of positions being such that detonations of the inside explosive detonated by the detonations of the outside explosive are completed earlier than the detonation of the bursting charge initiated by the detonations of the inside explosive.

10. The blast treatment device according to claim 9, wherein both ends of the outside explosive in the particular direction are connected to the common initiation device.

* * * * *